US008240809B2

(12) United States Patent
Okada

(10) Patent No.: US 8,240,809 B2
(45) Date of Patent: Aug. 14, 2012

(54) INK-JET RECORDING APPARATUS

(75) Inventor: Goro Okada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 852 days.

(21) Appl. No.: 11/760,544

(22) Filed: Jun. 8, 2007

(65) Prior Publication Data

US 2007/0285461 A1 Dec. 13, 2007

(30) Foreign Application Priority Data

Jun. 12, 2006 (JP) ..... 2006-162073

(51) Int. Cl.
*B41J 2/165* (2006.01)

(52) U.S. Cl. ..... 347/31

(58) Field of Classification Search ..... None
See application file for complete search history.

(56) References Cited

U.S. PATENT DOCUMENTS

| | | | | |
|---|---|---|---|---|
| 5,557,306 | A | 9/1996 | Fukushima et al. | |
| 5,905,514 | A * | 5/1999 | Rhoads et al. | 347/33 |
| 6,866,361 | B2 * | 3/2005 | Kuki et al. | 347/22 |
| 7,380,903 | B2 | 6/2008 | Kachi | |
| 2004/0155919 | A1 * | 8/2004 | Michele et al. | 347/28 |
| 2004/0155920 | A1 * | 8/2004 | Umeda et al. | 347/30 |
| 2005/0062797 | A1 * | 3/2005 | Kachi | 347/33 |
| 2005/0231548 | A1 | 10/2005 | Tsukada | |

FOREIGN PATENT DOCUMENTS

| | | | |
|---|---|---|---|
| JP | 3258553 | A | 11/1991 |
| JP | 11342621 | A | 12/1999 |
| JP | 2002361879 | A | 12/2002 |
| JP | 2004074774 | A | 3/2004 |
| JP | 2005022200 | A | 1/2005 |

OTHER PUBLICATIONS

Japanese Office Action issued in corresponding Japanese Application No. 2006-162073, dated Apr. 28, 2008.

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

An ink-jet recording apparatus includes: an ink-jet head including a plurality of nozzle openings from which ink is ejected and an ink ejection surface in which the plurality of nozzle openings are formed; a waste-ink receiving mechanism which receives the ink ejected from the plurality of nozzle openings; a set of (a) a wiper configured to wipe the ink adhering to the ink ejection surface and (b) an absorbing member configured to absorb the ink received by the waste-ink receiving mechanism and to be brought into contact with the ink ejection surface such that the absorbing member adheres the ink thereto; and a driving mechanism configured to drive at least one of the ink-jet head and the set of the wiper and the absorbing member, such that the wiper and the absorbing member are, one of together and independently, moved relative to the ink ejection surface while being opposed thereto, and such that the absorbing member adheres the ink to the ink ejection surface and the wiper wipes the ink adhered by the absorbing member from the ink ejection surface.

25 Claims, 11 Drawing Sheets

INK-JET RECORDING APPARATUS

The present application is based on Japanese Patent Application No. 2006-162073 filed on Jun. 12, 2006, the contents of which are incorporated herein by reference.

BACKGROUND OF THE INVENTION

1. Field of the Invention

The present invention relates to an ink-jet recording apparatus which ejects ink on a recording medium.

2. Description of the Related Art

There is known an ink-jet recording apparatus, as disclosed by JP-2004-74774A, including a head having a plurality of nozzle openings from which ink is ejected and a wiper which wipes the ink adhering to an ink ejection surface (that is, a surface in which the nozzle openings are formed) of the head. According to the apparatus, a wiper is driven to perform a wiping operation, after a suction pump is driven in a state in which a cap is fitted over the ink ejection surface so as to produce a negative pressure in the cap so that the ink is forced to be discharged from the nozzle openings of the ink ejection surface. In the wiping operation, the wiper formed of an elastic material such as a rubber is moved relative to the head while being in contact with the ink ejection surface of the head, whereby excess ink and the like adhering to the nozzle openings and their peripheries are removed and meniscuses of the ink formed in the nozzles are adjusted to their preferred condition.

However, in the above-mentioned wiping operation, the ink, foreign substances, and the like adhering to the ink ejection surface at the peripheries of the nozzle openings cannot be sufficiently removed, thereby causing a risk of deteriorating a print quality.

SUMMARY OF THE INVENTION

This invention has been developed in view of the above-described situations, and it is an object of the present invention to provide an ink-jet recording apparatus which is capable of sufficiently removing ink, foreign substances, and the like adhering to an ink ejection surface at peripheries of nozzle openings.

The object indicated above may be achieved according to the present invention which provides an ink-jet recording apparatus, comprising: an ink-jet head including a plurality of nozzle openings from which ink is ejected and an ink ejection surface in which the plurality of nozzle openings are formed; a waste-ink receiving mechanism which receives the ink ejected from the plurality of nozzle openings; a set of (a) a wiper configured to wipe the ink adhering to the ink ejection surface and (b) an absorbing member configured to absorb the ink received by the waste-ink receiving mechanism and to be brought into contact with the ink ejection surface such that the absorbing member adheres the ink thereto; and a driving mechanism configured to drive at least one of the ink-jet head and the set of the wiper and the absorbing member, such that the wiper and the absorbing member are, one of together and independently, moved relative to the ink ejection surface while being opposed thereto, and such that the absorbing member adheres the ink to the ink ejection surface and the wiper wipes the ink adhered by the absorbing member from the ink ejection surface.

In the ink-jet recording apparatus constructed as described above, the ink adhered by the absorbing member and the ink already adhered to the ink ejection surface are wiped together, thereby sufficiently removing the ink, the foreign substances, and the like adhering to the ink ejection surface at the peripheries of the nozzle openings.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Hereinafter, there will be described preferred embodiments of the present invention by reference to the drawings.

First, referring to FIGS. 1, 2, 3, and 4, there will be described an overall construction of an ink-jet printer 1 according to an embodiment of the present invention. The ink-jet printer 1 according to the present embodiment is a color ink-jet printer of a line-type having four ink-jet heads 2.

Head main bodies 2*a* are provided at lower ends of the respective heads 2, and the four heads 2 are arranged adjacently to each other along a direction in which a recording medium is fed (hereinafter, referred to as a "sheet-feed direction"), with the head main bodies 2*a* being near to each other. Each of the head main bodies 2*a* has a rectangular flat plate-like shape (as shown in FIG. 2) elongated in a direction perpendicular to the sheet surface of FIG. 1 (namely, a direction perpendicular to the sheet-feed direction), and a length of each head main body 2*a* is larger than a width of a recording sheet as a recording medium. A lower surface of each head main body 2*a* constitutes an ink ejection surface 2*b* in which there are formed a plurality of nozzle openings 28 (as shown in FIG. 3) from which ink is ejected, and inks of four colors, namely, magenta, yellow, cyan, and black, are respectively ejected from the ink ejection surfaces 2*b* of the respective four head main bodies 2*a*.

Figure 2:
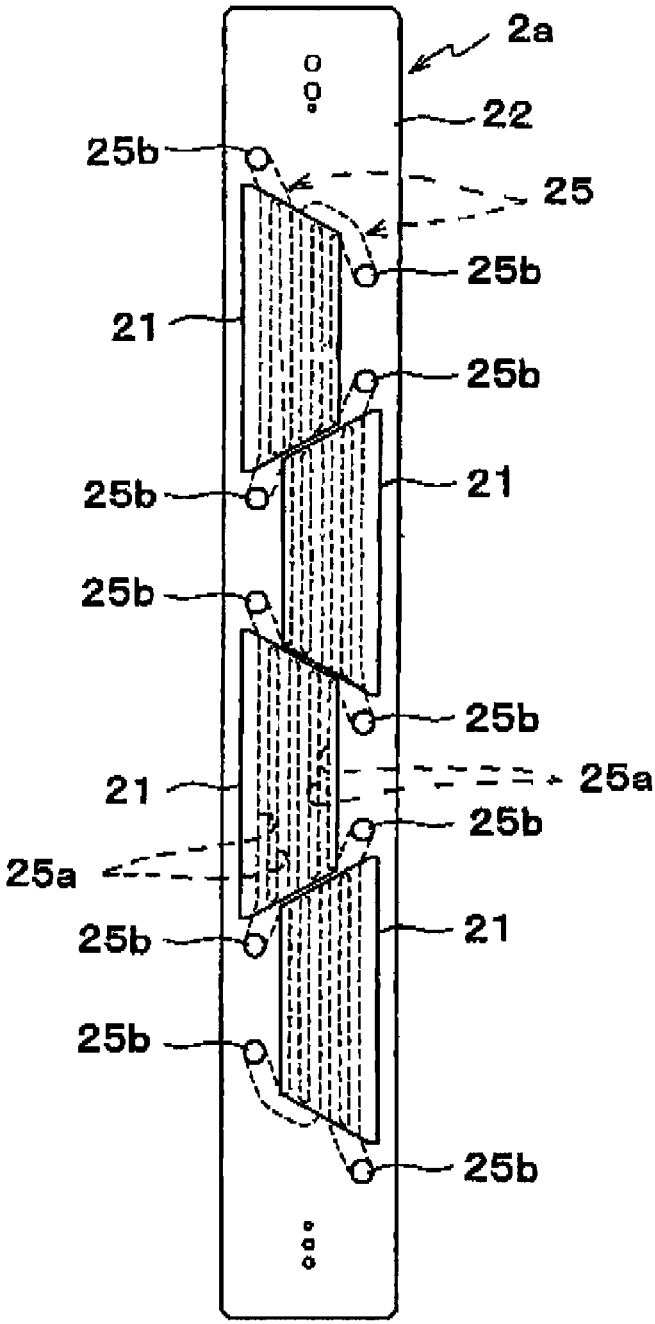
FIG. 2 is a plan view of one of four ink-jet heads shown in FIG. 1.
Figure 3:
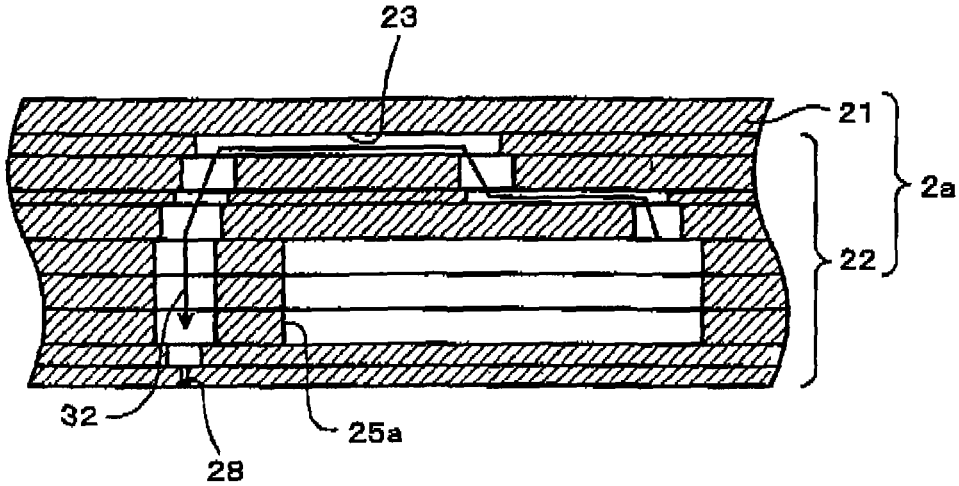
FIG. 3 is a cross-sectional view of a part of the ink-jet head.

As shown in FIGS. 2 and 3, each head main body 2*a* includes a channel unit 22 having a rectangular shape in plane view and formed by stacking nine plates one on another, and four actuator units 21 each having a trapezoid shape and arranged in a staggered configuration on an upper surface of the channel unit 22. Portions of a lower surface of the channel unit 22 corresponding to the actuator units 21 constitute an ink ejection area in which the plurality of nozzle openings 28 are formed. In the upper surface of the channel unit 22, there are formed a plurality of pressure chambers 23 each of which communicates with a corresponding nozzle, and each of the actuator units 21 is disposed to cover a corresponding part of the plurality of pressure chambers 23. In the channel unit 22, there are formed: manifold channels 25 each provided for storing the ink to be supplied to a corresponding part of the pressure chambers 23; sub-manifold channels 25*a* which are branched from a corresponding one of the manifold channels 25; and ink channels 32 which correspond to the nozzles, respectively and each of which extends from a corresponding one of the sub-manifold channels 25*a* to a corresponding one of the nozzle openings 28 via a corresponding one of the pressure chambers 23, as shown in FIG. 3. The ink in an ink tank (not shown) is supplied to the manifold channels 25 via openings 25*b* formed in the upper surface of each channel unit 22 and is distributed to the pressure chambers 23. When the pressure chambers 23 are selectively pressurized by the actuator units 21, a pressure of the ink in each of the pressure chambers 23 rises so that the ink is ejected from the nozzle openings 28 which communicates with the pressure chambers 23.

Figure 1:
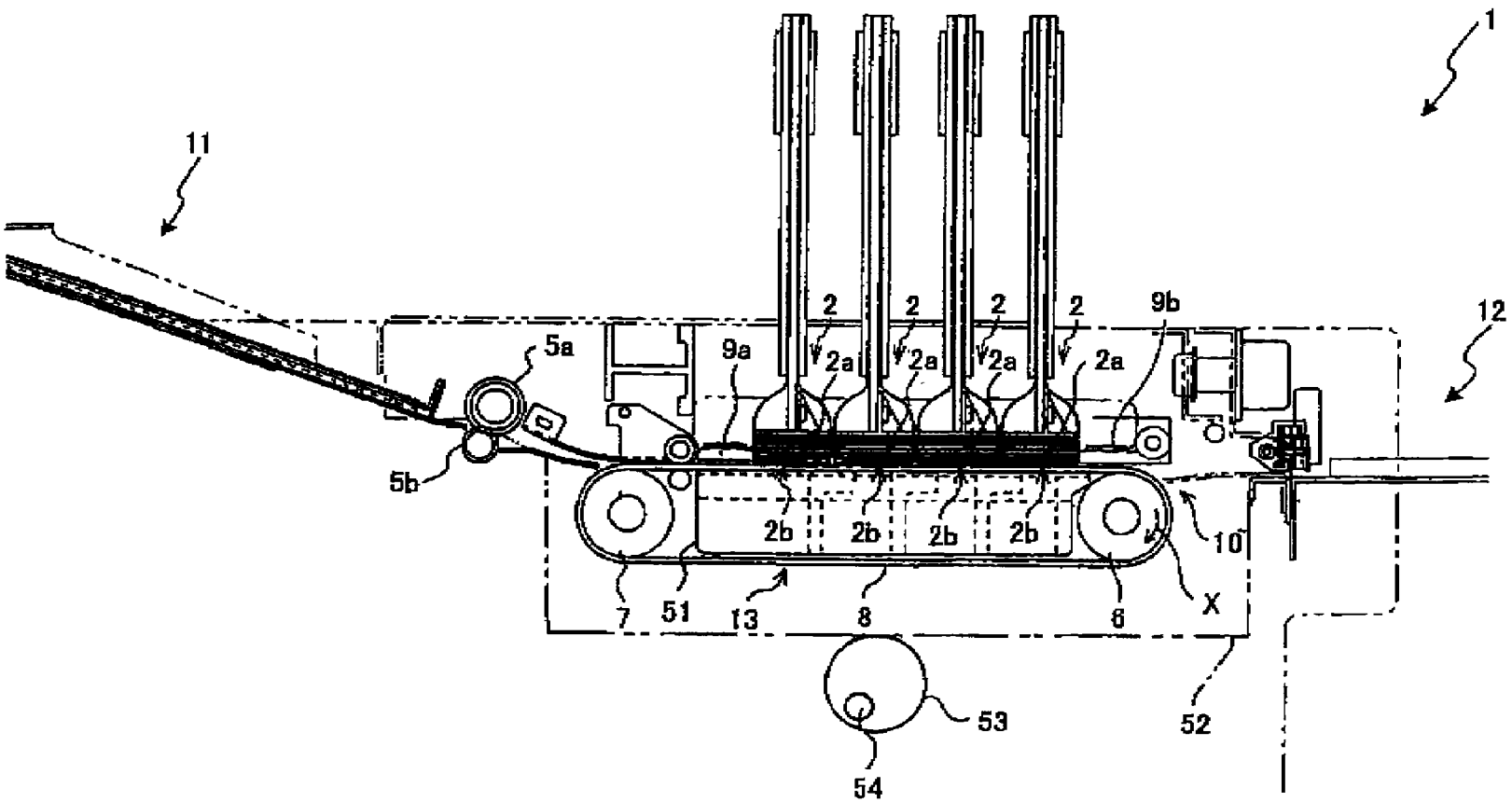
FIG. 1 is a front elevational view showing an ink-jet printer according to an embodiment of the present invention.

As shown in FIG. 1, the four ink ejection surfaces 2*b* of the heads 2 are arranged in a horizontal direction, and a sheet-feed mechanism 13 is disposed such that the ink ejection surfaces 2*b* are opposed to an outer surface of an upper portion of a sheet-feed belt 8 having a loop-like form, with a small amount of spacing interposed between the ink ejection surfaces 2*b* and the outer surface. The sheet-feed mechanism 13 includes two rollers 6, 7 and the loop-like sheet-feed belt 8 wound around the rollers 6, 7 so as to be stretched between the rollers 6, 7. The roller 6 is rotated in a clockwise direction in FIG. 1 (a direction indicated by arrow X) so as to circulate the sheet-feed belt 8, whereby the roller 7 is rotated. The sheet-feed mechanism 13 further includes a belt guide 51 disposed in an area surrounded by the sheet-feed belt 8. The belt guide 51 has a generally rectangular parallelepiped shape having substantially the same width as the sheet-feed belt 8 and supports the sheet-feed belt 8 with an upper surface of the belt guide 51 held in contact with an inner surface of the upper portion of the sheet-feed belt 8.

Recording sheets as recording media are stacked and accommodated in a sheet-supply section 11 (in a left portion of FIG. 1), and successively fed from the uppermost sheet onto the sheet-feed belt 8, while being nipped by a pair of sheet-feed rollers 5*a*, 5*b*. The recording sheet moves below the ink ejection surfaces 2*b* of the heads 2 in accordance with the circulation of the sheet-feed belt 8, while being held on the outer surface of the upper portion of the sheet-feed belt 8. At this time, the inks of the four colors are ejected from the respective ink ejection surfaces 2*b*, whereby a desired color image is formed on the sheet. The sheet on which an image is thus formed is peeled off from the outer surface of the sheet-feed belt 8 by a peeling plate 10 and fed to a sheet-discharge section 12 (in a right portion of FIG. 1).

The sheet-feed belt 8 has a bilayer structure in which silicon rubber and polyester base material impregnated with urethane are superposed on each other, and the outer surface of the sheet-feed belt 8 is constituted by the silicon rubber. The recording sheet fed by the sheet-feed rollers 5*a*, 5*b* is pressed onto the outer surface of the sheet-feed belt 8 by a pressing member 9*a* and then fed in accordance with the circulation of the sheet-feed belt 8, while being held on the outer surface of the sheet-feed belt 8 by an adhesion thereof. There is provided another pressing member 9*b* which is located on one of opposite sides of the four heads 2, which is opposite to the pressing member 9*a*, that is, the pressing member 9*b* is provided on a downstream side in the sheet-feed direction.

The sheet-feed mechanism 13 is supported by a raising and lowering mechanism including a chassis 52 and a cylindrical member 53 which is rotatable about an eccentric shaft 54, such that the sheet-feed mechanism 13 is movable upward and downward. The chassis 52 rotatably supports the rollers 6, 7 of the sheet-feed mechanism 13 and is supported on a circumferential surface of the cylindrical member 53 disposed under the chassis 52. A height position of an upper end of the cylindrical member 53 is changed when the cylindrical member 53 is rotated about the eccentric shaft 54, whereby the chassis 52 is moved upward and downward together with the sheet-feed mechanism 13.

Figure 4:
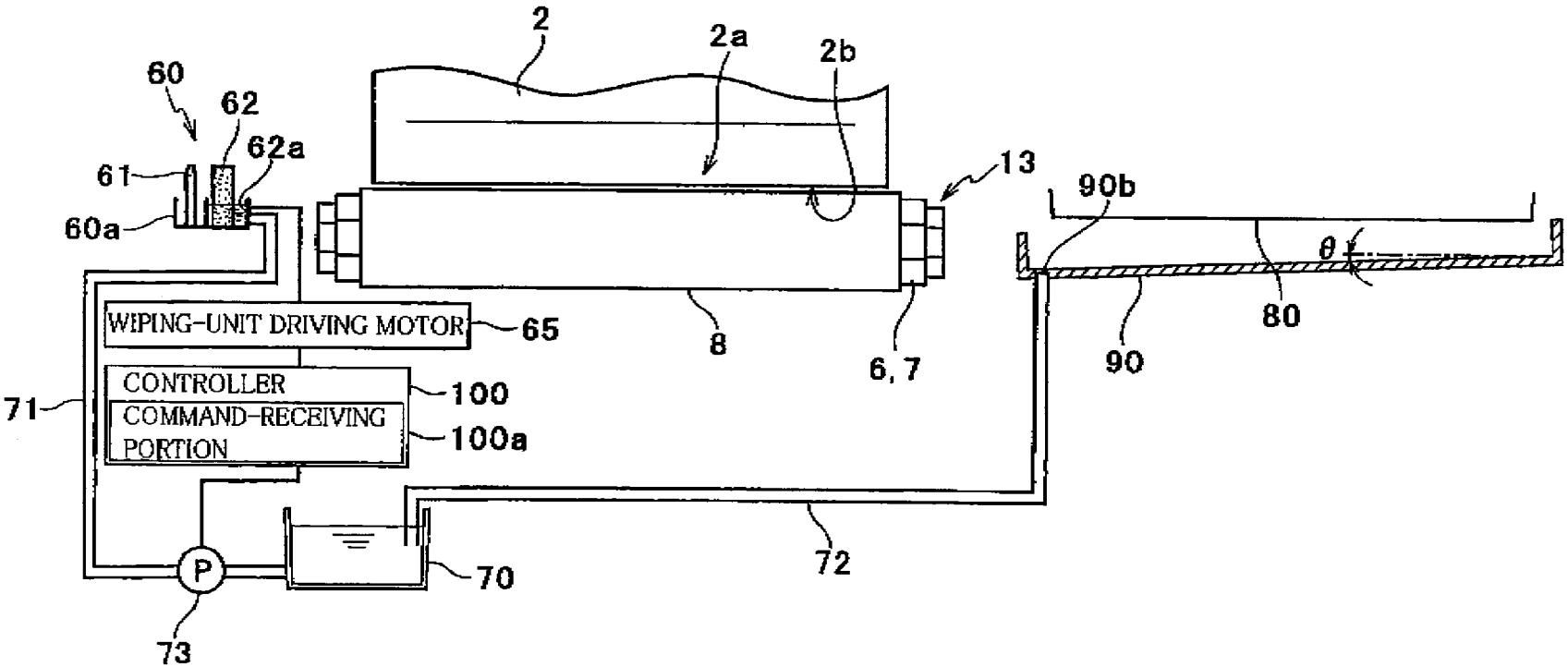
FIG. 4 is a side view schematically showing an ink-jet printer in a printing operation.
Figure 5:
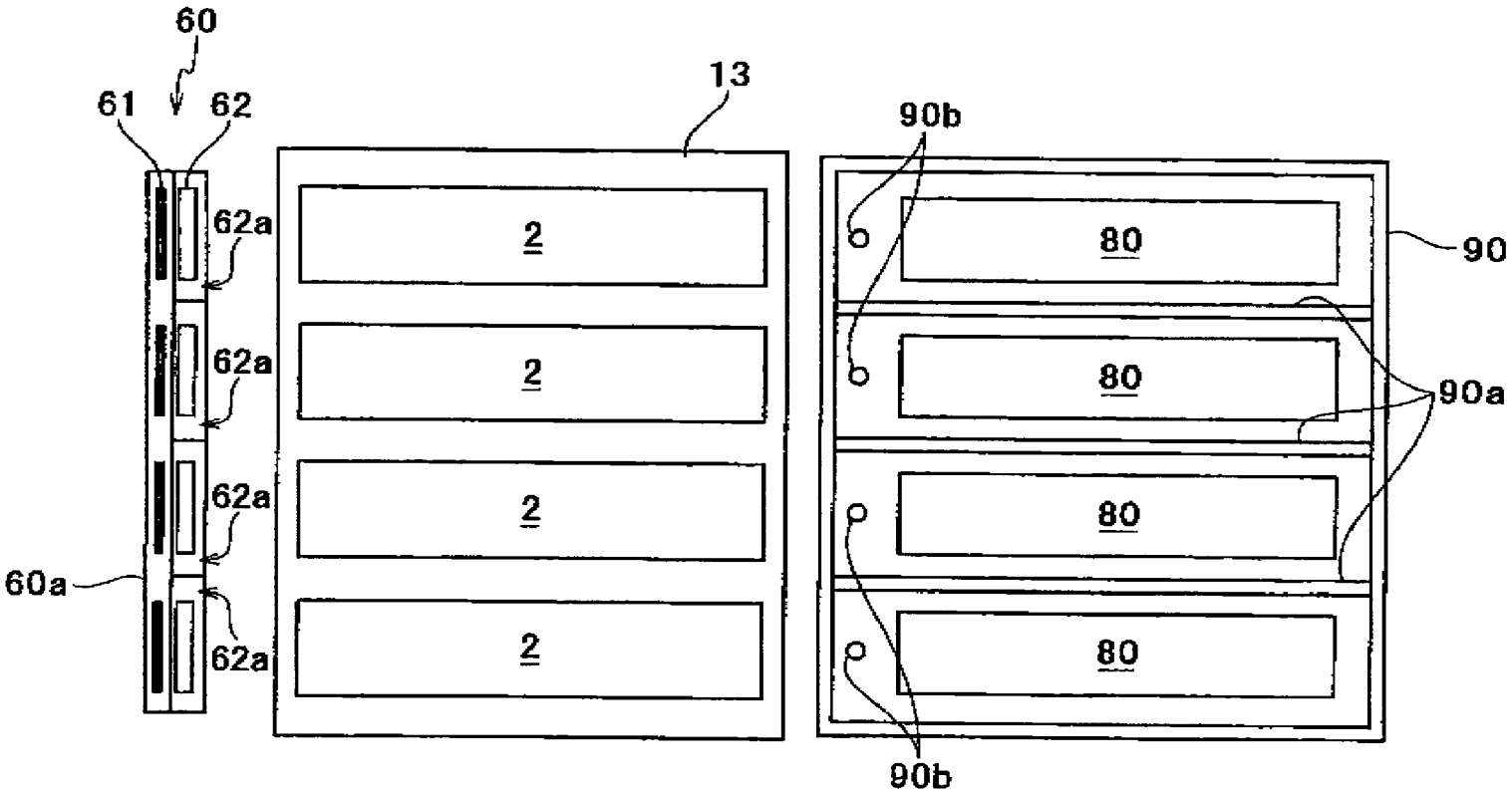
FIG. 5 is a plan view schematically showing the ink-jet printer in the printing operation.

As shown in FIG. 4, the ink-jet printer 1 further includes a wiping unit 60. The wiping unit 60 has wipers 61 for wiping the ink adhering to the ink ejection surfaces 2*b* and sponges (absorbing members) 62 holding the ink supplied from a waste ink tank (container) 70 described below. A set of one of the wipers 61 and one of the sponges 62 is shown in FIG. 4, but as shown in FIG. 5, the sets of the wipers 61 and sponges 62 are respectively provided for the four heads 2. Four sets of the wipers 61 and the sponges 62 are supported on a frame 60*a*.

For each of the heads 2, the wiper 61 has substantially the same width (a length in a direction perpendicular to the sheet surface of FIG. 4) as the ink ejection surface 2*b*. The wiper 61 is a plate-like member made of a flexible material such as a polyurethane rubber, and is vertically fixed to a bottom surface of the frame 60*a* along a width direction of the ink ejection surface 2*b*. The sponge 62 is a rectangular parallelepiped member having substantially the same width as the ink ejection surface 2*b* (as shown in FIG. 5), and vertically fixed to the bottom surface of the frame 60*a* along the width direction of the ink ejection surface 2*b*.

As shown in FIG. 5, an inside of the frame 60*a* is partitioned so as to define areas 62*a* in which the sponges 62 are respectively disposed. Each sponge 62 having a porous structure absorbs the ink supplied to a corresponding one of the areas 62*a* from the waste ink tank 70 described below as shown in FIG. 4, and is brought into contact with the corresponding ink ejection surface 2*b*, whereby the ink is adhered to the corresponding ink ejection surface 2*b*. In each area 62*a*, the ink supplied from the waste ink tank 70 is kept stored in a constant amount, such that the whole sponge 62 retains a suitable amount of the ink.

The frame 60*a* is movably supported by a supporting mechanism (not shown) so as to move in a longitudinal direction of the ink ejection surfaces 2*b* (i.e., in a right and left direction of FIG. 4). When a wiping-unit driving motor (driving mechanism) 65 is driven by a control of a controller 100, the supporting mechanism is operated to move the frame 60*a* along the longitudinal direction of the ink ejection surfaces 2*b*.

In a stand-by position as shown in FIG. 4 (i.e., in a position in which the wiping unit 60 is located when not operated), the wiping unit 60 is disposed such that a distal end of each sponge 62 is positioned slightly above the ink ejection surface 2*b* in a vertical direction, and a distal end of each wiper 61 is positioned slightly above the distal end of each sponge 62 in the vertical direction. As described in greater detail below, a position of the entire wiping unit 60 in the vertical direction is changeable in a wiping operation, but a positional relationship between the wiper 61 and the sponge 62 of each set in the vertical direction is maintained such that the distal end of the wiper 61 is positioned above the distal end of the sponge 62 in the vertical direction, that is, the distal end of the wiper 61 is located nearer to the ink ejection surface 2*b* than the distal end of the sponge 62 in a direction perpendicular to the ink ejection surface 2*b*.

On one of opposite sides of the ink-jet heads 2, which is opposite to the wiping unit 60, that is, in a back of the sheet-feed mechanism 13 in FIG. 1, there are provided caps 80 for covering the ink ejection surfaces 2*b*, respectively, to prevent the ink at the peripheries of the nozzles from drying, and a waste ink tray 90 for receiving the ink ejected from the ink ejection surfaces 2*b* during a purging operation. The four caps 80 are provided respectively corresponding to the heads 2 (as shown in FIG. 5), and a contact surface of each of the caps 80 which comes into contact with the corresponding ink ejection surface 2*b* is formed of an elastic material such as a rubber so as to come into close contact with and cover the corresponding ink ejection surface 2*b*. The waste ink tray 90 has a box-like shape opening upward and a bottom surface thereof is inclined by an angle θ (FIG. 4) with respect to the ink ejection surfaces 2*b* so as to decline toward one of opposite ends thereof in which through-holes 90*b* are formed. It is noted that the waste ink tray 90 may have the bottom surface inclined such that a distance between the bottom surface and the ink ejection surface gradually increases toward the through-holes 90*b* which are formed in certain portions of the bottom surface. The four through-holes 90*b* are formed respectively corresponding to the heads 2, and an inside of the waste ink tray 90 is partitioned by partitions 90*a* so as to define areas respectively corresponding to the heads 2.

There are provided tubes 72 each of which has one end fitted to a corresponding one of the through-holes 90*b* formed in the bottom surface of the waste ink tray 90, and which has the other end disposed in the waste ink tank 70. The waste ink tank 70 is disposed below the heads 2 and the sheet-feed mechanism 13. Like the waste ink tray 90, an inside of the waste ink tank 70 is partitioned so as to define areas respectively corresponding to the heads 2. For each of the tubes 72, the other end of the tube 72 is disposed in the area defined in the waste ink tank 70, so that the ink received in the area in the waste ink tray 90 are flowed into the tube 72 via the through-hole 90*b* and then sent to the area in the waste ink tank 70 from the tube 72.

The waste ink tank 70 is further connected to four tubes 71 each of which connects a corresponding one of the areas in the waste ink tank 70 with a corresponding one of the areas 62*a* defined in the frame 60*a* of the wiping unit 60. Pumps (suppliers) 73 are provided for the respective tubes 71, and when the pumps 73 are driven by a control of the controller 100, the ink each stored in the area in the waste ink tank 70 is supplied to the area 62*a* via the tube 71. Drives of the pumps 73 are controlled by the controller 100 such that the ink each supplied from the waste ink tank 70 to the area 62*a* is kept stored in the area 62*a* at a constant amount. It is noted that mechanisms which receives the ink ejected from the nozzle openings 28 and respectively corresponding to the heads 2 are referred to as "waste-ink receiving mechanisms". The waste-ink receiving mechanism provided for each head 2 includes the area in the waste ink tray 90, the area in the waste ink tank 70, the pump 73, and the tube 71.

FIG. 4 shows a placement of various parts of the printer in a printing operation. In this placement, the sheet-feed mechanism 13 is disposed right below the four heads 2, and more specifically, disposed in a sheet-feed position in which the ink ejection surfaces 2*b* of the heads 2 are opposed to the outer surface of the upper portion of the sheet-feed belt 8 with a small amount of spacing interposed therebetween. The wiping unit 60 is disposed in its stand-by position located in front of the sheet-feed mechanism 13 in FIG. 1. Further, the caps 80 and the waste ink tray 90 are disposed in their stand-by position located in the back of the sheet-feed mechanism 13 in FIG. 1.

Figure 6:
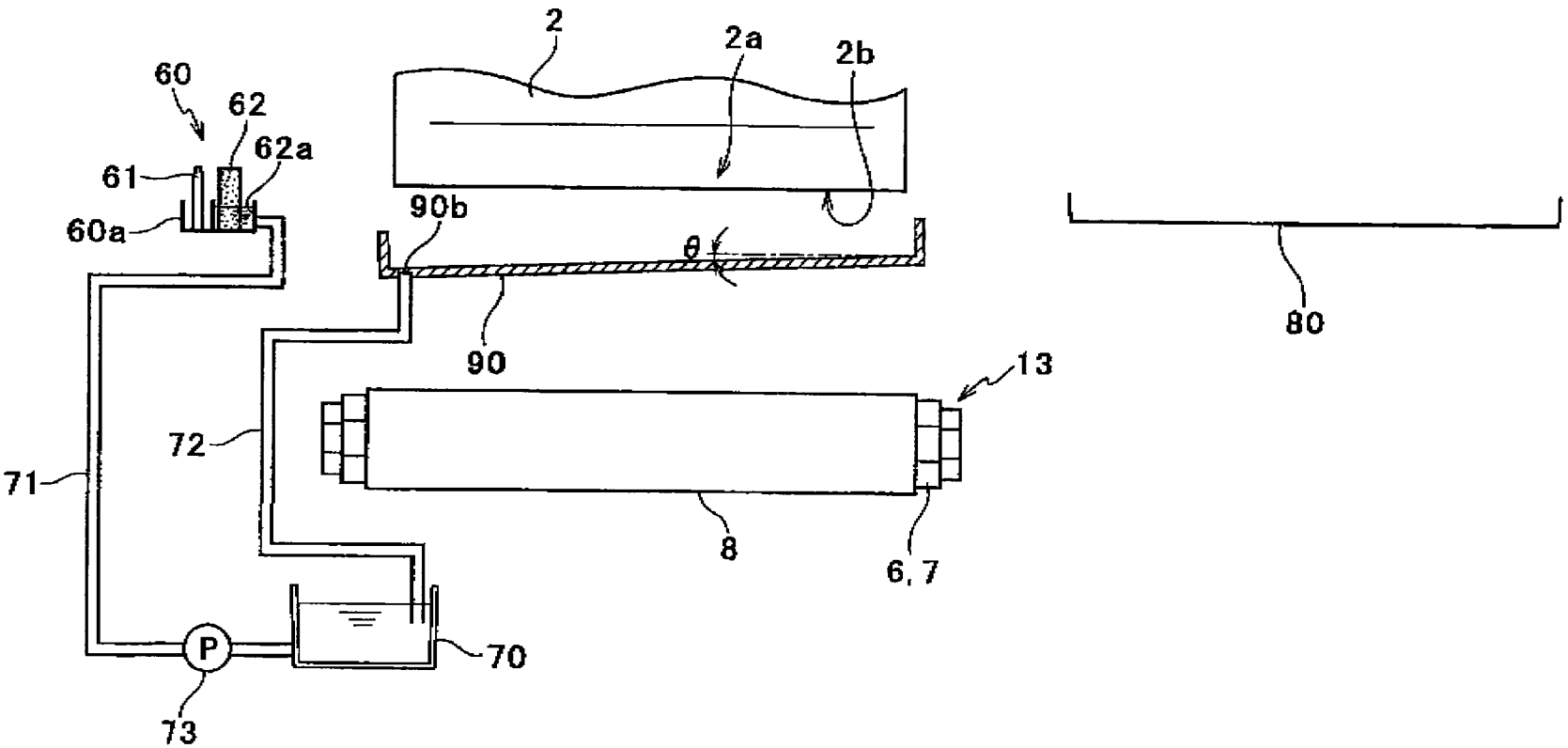
FIG. 6 is a side view schematically showing the ink-jet printer in a purging operation.

FIG. 6 shows a placement of various parts of the printer in the purging operation. The purging operation is an operation in which the ink is forced to be ejected from the nozzles of the heads 2 (and can be referred to as a "flushing operation"), and performed when a power is turned on to the printer 1, when an ink cartridge (not shown) is replaced, or when a command-receiving portion 100*a* (as shown in FIG. 4) of the controller 100 receives a purging command which is inputted by a user via an input device (not shown).

In the purging operation, first, the sheet-feed mechanism 13 is lowered from a printing position (i.e., the sheet-feed position) thereof shown in FIG. 4 by the raising and lowering mechanism, and stopped at its stand-by position in which a space for disposing the waste ink tray 90 is secured. And then, the waste ink tray 90 is moved by a moving mechanism (not shown) from its stand-by position shown in FIG. 4 to an area located between the heads 2 and the sheet-feed mechanism 13. After the areas in the waste ink tray 90 are thus disposed right below the heads 2, so as to be opposed thereto, respectively, the heads 2 are driven to force the ink to be ejected from the nozzles, and the ejected ink is received in the areas in the waste ink tray 90. The bottom surface of the waste ink tray 90 declines toward the one end thereof in which through-holes 90*b* are formed, such that a distance between the bottom surface and the ink ejection surfaces 2*b* gradually increases toward the one end of the waste ink tray 90, whereby the ink each received in the area in the waste ink tray 90 is flowed toward the one end of the waste ink tray 90 and then flowed into the tube 72 fitted to the through-hole 90*b*. Further, the inks of four colors are sent into the respective areas in the waste ink tank 70 through the respective tubes 72 and stored in the waste ink tank 70.

Next, there will be explained operations of the various parts of the printer in a wiping operation. The wiping operation is an operation in which excess ink and the like adhering to the nozzle openings 28 of the ink ejection surfaces 2*b* and their peripheries are removed by the wipers 60 and the sponges 62 of the wiping unit 60, and meniscuses of the ink formed in the nozzles are adjusted to their preferred condition. The wiping operation is performed when a number of recorded sheets reaches a predetermined number after the purging operation and when the command-receiving portion 100*a* (as shown in FIG. 4) of the controller 100 receives a wiping command which is inputted by a user via an input device (not shown).

In the wiping operation, first, as shown in FIG. 6, the sheet-feed mechanism 13 is moved to its stand-by position and the waste ink tray 90 is disposed right below the heads 2 so as to be opposed thereto as in the purging operation. Then, the wiping-unit driving motor 65 is driven by a control of the controller 100 and the wiping unit 60 is moved along the longitudinal direction of the ink ejection surfaces 2*b* toward an area located below the ink ejection surfaces 2*b*.

Figure 7:
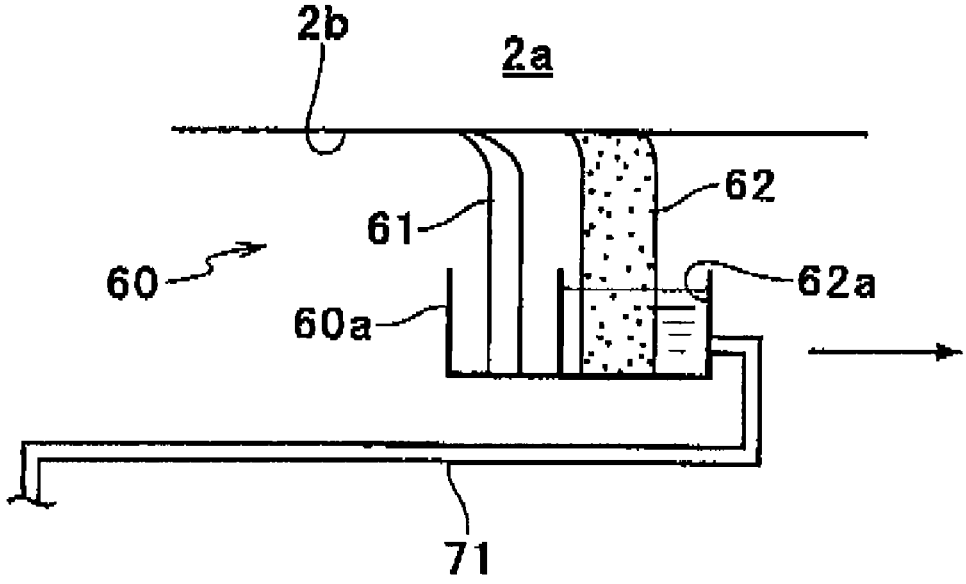
FIG. 7 is a view for explaining a movement of a wiping unit in a wiping operation.

When the sponge 62 for each head 2 is opposed to the corresponding ink ejection surface 2*b* in accordance with a movement of the wiping unit 60, a distal end of the sponge 62 is brought into contact with the ink ejection surface 2*b*, so that the sponge 62 is slightly flexed as shown in FIG. 7. The ink held in the sponge 62 is adhered to the ink ejection surface 2*b* which is held in contact with the distal end of the sponge 62. The sponge 62 whose distal end is thus held in contact with the ink ejection surface 2*b* is moved along the longitudinal direction of the ink ejection surface 2*b*, whereby the ink held in the sponge 62 is adhered to an entirety of the ink ejection surface 2*b*.

Like the sponges 62, when the wiper 61 for each head 2 is opposed to the corresponding ink ejection surface 2*b* in accordance with the movement of the wiping unit 60, a distal end of the wiper 61 is brought into contact with the ink ejection surface 2*b*, so that the wiper 61 is flexed. With this state maintained, the wiper 61 is moved along the longitudinal direction of the ink ejection surface 2*b*, whereby the wiper 61 wipes, from the ink ejection surface 2*b*, the ink and the foreign substances already adhered to the ink ejection surface 2*b* before the wiping operation and the ink adhered to the ink ejection surface 2*b* by the sponge 62 as described above.

The wiping unit 60 is moved from one of opposite ends of each head 2 in a longitudinal direction thereof (a left end portion of the head 2 in FIG. 6) to the other of the opposite ends of each head 2 (a right end portion of the head 2 in FIG. 6), while being opposed to the ink ejection surfaces 2*b*. Owing to this movement, the excess ink and the like adhering to the nozzle openings 28 and their peripheries are removed, so that meniscuses of the ink formed in the nozzles are adjusted to their preferred condition in the entire ink ejection surfaces 2*b*.

When the sponge 62 and the wiper 61 of each set are passed through the other opposite end of the head 2 and the flexed distal portions of the sponge 62 and the wiper 61 are returned to their original state, the controller 100 stops the wiping-unit driving motor 65 from driving. Then, after the frame 60*a* is slightly lowered such that the distal ends of the sponge 62 and the wiper 61 are positioned below the ink ejection surface 2*b* in the vertical direction perpendicular to the ink ejection surface 2*b*, the wiping unit 60 is moved in a horizontal direction to its stand-by position shown in FIG. 4 and stopped at the stand-by position.

As described above, according to the present embodiment, in the wiping operation, the ink adhered by the sponges 62 and the ink already adhered to the ink ejection surfaces 2*b* are wiped together by the wipers 61, whereby the ink, the foreign substances, and the like adhering to the nozzles of the ink ejection surfaces 2*b* can be sufficiently removed.

Further, in the present embodiment, the ink ejected from the nozzles as useless ink in the purging operation or the like is received in the waste ink tray 90, and the received ink is reused in the wiping operation, thereby reducing a running cost of the apparatus compared to the case where a cleaning liquid or the like is used.

Because the waste ink tray 90 has the bottom surface inclined toward one of opposite ends thereof, the ink ejected to the bottom surface of the waste ink tray 90 from the nozzles in the purging operation is spontaneously collected at the one end of the bottom surface of the waste ink tray 90, and the ink is flowed from the one end of the bottom surface and received in the waste ink tank 70 via the tubes 72. Thus, the ink is efficiently received and the received ink is supplied to the sponges 62 by the pumps 73, so that a desired amount of the ink can be absorbed in the sponges 62.

As the number of the recorded sheets increases, a viscosity of the ink adhering to the ink ejection surfaces 2*b* accordingly increases, thereby making it difficult to remove the ink and the foreign substances adhering to the ink ejection surfaces 2*b* in the wiping operation. For this reason, the controller 100 is operated to control the wiping-unit driving motor 65 to perform the wiping operation on the basis of the number of the recorded sheets by the heads 2, whereby the ink and the foreign substances adhering to the ink ejection surfaces 2*b* can be effectively removed, and a stable ink ejection can be realized for a long time.

The controller 100 has the command-receiving portion 100*a* which receives a wiping command inputted by a user, and the controller 100 controls the wiping-unit driving motor 65 such that the wiping operation is performed when the command-receiving portion 100*a* receives the wiping command. That is, for instance, when a user visually identifies a printing failure on a recording sheet, the user inputs the wiping command, and the wiping-unit driving motor 65 is controlled such that the wiping operation is performed in response to the wiping command. Thus, a stable ink ejection can be realized with higher reliability by taking into consideration not only the number of the recorded sheets but also user's intention.

The ink-jet printer 1 according to the present embodiment includes the four ink-jet heads 2 configured to respectively eject the inks mutually different in a sort and both of the inside of the waste ink tray 90 and the inside of the waste ink tank 70 are partitioned so as to form the areas corresponding to the respective heads 2. If any one of the waste ink tray 90 and the waste ink tank 70 is not partitioned or an area which is common for the four heads 2 is formed, the inks mutually different in a sort for the respective heads 2 are mixed, thereby causing problems such as an aggregation. However, as described in the present embodiment, the areas are independently formed for the respective heads 2 in the waste ink tray 90 and the waste ink tank 70, whereby the problems can be avoided.

The sets of the sponges 62 and the wipers 61 are also independently provided for the respective four heads 2. If a set of the sponge 62 and the wiper 61 is provided in common for the four heads 2, the inks mutually different in a sort are mixed, thereby causing the problems such as the aggregation. However, as described in the present embodiment, the sets of the sponges 62 and the wipers 61 are independently provided for the respective heads 2, whereby the problems can be avoided.

Further, in the present embodiment, in each head 2, the ink adhered to the ink ejection surface 2*b* by the sponge 62 and the ink ejected from the nozzle openings are the same in a sort, thereby preventing the inks mutually different in a sort from mixing with each other on the ink ejection surface 2*b*.

While the wiping unit 60 is moved along the longitudinal direction of the ink ejection surface 2*b* of each head 2 in the wiping operation, the distal end of the sponge 62 is kept to be positioned further from the ink ejection surface 2*b* than the distal end of the wiper 61 in the vertical direction perpendicular to the ink ejection surface 2*b*. Therefore, as shown in FIG. 7, when the wiping-unit driving motor 65 is driven in a state in which the distal end of the sponge 62 is held in contact with the ink ejection surface 2*b*, the distal end of the wiper 61 which is positioned nearer to the ink ejection surface 2*b* than the distal end of the sponge 62 is held in contact with the ink ejection surface 2*b* while being flexed and generating an elastic force, whereby the ink adhered by the sponge 62 and the ink already adhered before the wiping operation are effectively wiped by the wiper 61.

The sponge 62 and the wiper 61 of each set are located on a virtual straight line which extends in a direction (in a right and left direction in FIG. 6) in which the sponge 62 and the wiper 61 are moved relative to the head 2 when the wiping-unit driving motor 65 is driven, and the sponge 62 and the wiper 61 are moved along the virtual straight line. This is advantageous in an overall structure of the apparatus and a driving control because a structure of drives of the sponge 62 and the wiper 61 is relatively facilitated.

Further, the wiping-unit driving motor 65 moves the sponge 62 and the wiper 61 of each set together along the same virtual straight line at the same speed, thereby further facilitating the driving control of the sponge 62 and the wiper 61.

It is noted that FIG. 7 shows the case in which the wiping operation is performed using both of the sponge 62 and the wiper 61 and in which a position of the frame 60*a* in the vertical direction upon the wiping operation is the same as its stand-by position. However, where the ink ejection surface 2*b* is not stained so much, for instance, the wiping operation may be performed using only the wiper 61 without using the sponge 62.

Figure 8:
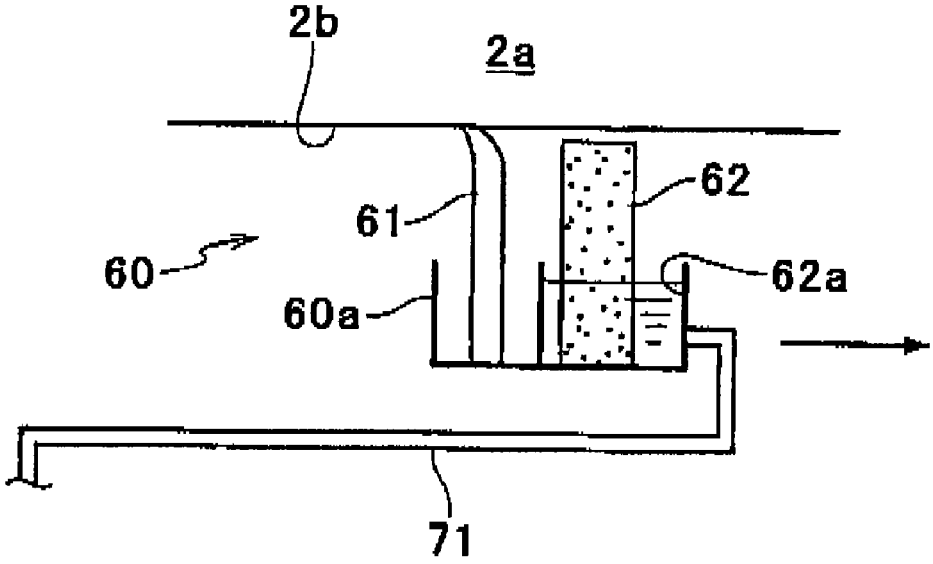
FIG. 8 is a view for explaining the movement of the wiping unit in the wiping operation performed only using a wiper.

In the case in which the wiping operation is performed using only the wiper 61, the frame 60*a* is lowered in the vertical direction from the standby position thereof shown in FIG. 4 before moved in parallel translation upon the wiping operation, and the wiping unit 60 is disposed such that the distal end of the sponge 62 is positioned slightly below the ink ejection surface 2*b* in the vertical direction and the distal end of the wiper 61 is positioned slightly above the ink ejection surface 2*b* in the vertical direction. Then, the wiping-unit driving motor 65 is driven so as to move the wiping unit 60 along the longitudinal direction of the ink ejection surface 2*b* toward an area located below the ink ejection surface 2*b*. In this case, as shown in FIG. 8, the distal end of the sponge 62 is not brought into contact with the ink ejection surface 2*b* even though the sponge 62 has reached a position in which the sponge 62 is opposed to the ink ejection surface 2*b*. On the other hand, the wiper 61 is held in contact with the ink ejection surface 2*b* with the distal end thereof being flexed in a smaller amount than the distal end of the wiper 61 shown in FIG. 7, and in this state, the wiper 61 is moved along the longitudinal direction of the ink ejection surface 2*b*. Therefore, the ink and the foreign substances already adhered to the ink ejection surface 2*b* before the wiping operation are wiped therefrom by the wiper 61.

Thus, in the present embodiment, a state in which the ink ejection surface 2*b* of each head 2 is in contact with both of the distal ends of the sponge 62 and the wiper 61 (as shown in FIG. 7) and a state in which the ink ejection surface 2*b* is not in contact with the distal end of the sponge 62 and in contact with the wiper 61 (as shown in FIG. 8) can be selectively established. For instance, where the ink ejection surface 2*b* is not stained so much, the state shown in FIG. 8 in which the ink ejection surface 2*b* is not in contact with the distal end of the sponge 62 and is in contact with the distal end of the wiper 61 is maintained. Where the ink ejection surface 2*b* is stained so much, the state shown in FIG. 7 in which the ink ejection surface 2*b* is in contact with the distal end of the sponge 62 and in which the distal end of the wiper 61 is in contact with the ink ejection surface 2*b* while being flexed is maintained. Therefore, the wiping operation using the sponge 62 and the wiper 61 and the wiping operation not using the sponge 62 but using only the wiper 61 can be selectively performed.

Figure 9A:
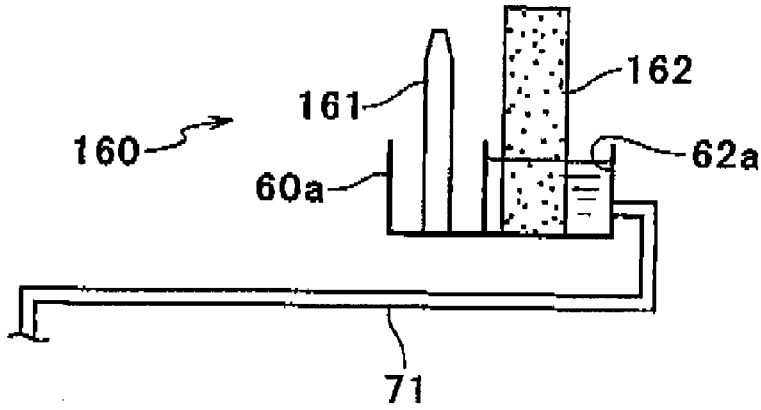
FIG. 9A is a schematic view showing a wiping unit as a first modified example.
Figure 9B:
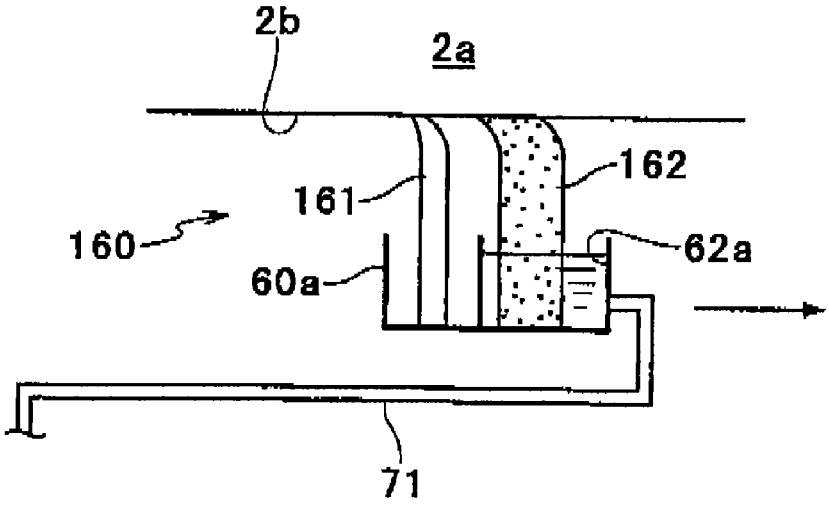
FIG. 9B is a view for explaining a movement of the wiping unit as the first modified example in the wiping operation.

Referring next to FIGS. 9A and 9B, there will be explained a first modified example of the wiping unit. In a wiping unit 160 of the first modified example, as shown in FIG. 9A, for each head 2, a positional relationship between a wiper 161 and a sponge 162 in the vertical direction is kept such that a distal end of the sponge 162 is located slightly above a distal end of the wiper 161. In the stand-by position shown in FIG. 4, the wiping unit 160 is disposed such that the distal end of the wiper 161 is located slightly above the ink ejection surface 2*b* in the vertical direction. In this case, as shown in FIG. 9B, the sponge 162 is flexed by a larger degree than the sponge 62 of the above-mentioned embodiment (shown in FIG. 7) when the wiping unit 160 is moved in parallel translation and the sponge 162 is opposed to the ink ejection surface 2*b* in the wiping operation. On the other hand, the wiper 161 is flexed by a smaller degree than the wiper 61 of the above-mentioned embodiment (shown in FIG. 7). Therefore, in the wiping unit 160 of the first modified example, a contact pressure at which the distal end of the wiper 161 contacts the ink ejection surface 2*b* can be reduced, thereby enhancing the durability of the wiper 161.

Figure 10:
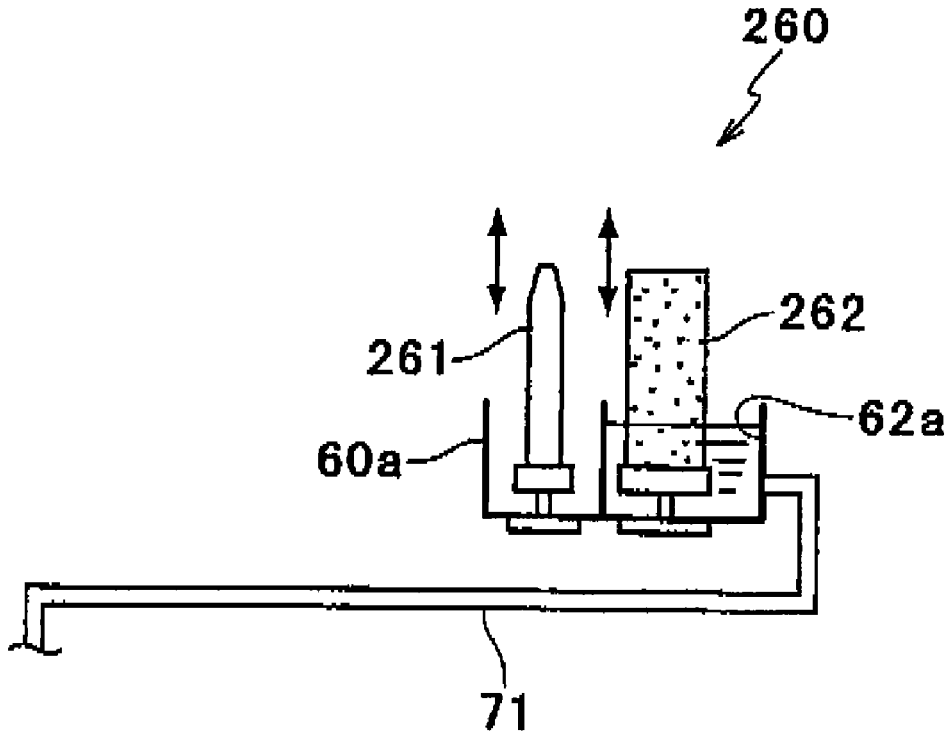
FIG. 10 is a schematic view showing a wiping unit as a second modified example.

Referring next to FIG. 10, there will be explained a second modified example of the wiping unit. In a wiping unit 260 of the second modified example, for each head 2, positions of a wiper 261 and a sponge 262 can be changed in the vertical direction. Various mechanisms can be employed as a mechanism configured such that the positions of the wiper 261 and the sponge 262 in the vertical direction are individually changed, but a detailed description of which is not given here. In the wiping unit 260 of the second modified example, for instance, the positions of the wiper 261 and the sponge 262 in the vertical direction are independently changed depending upon the flexibility or the durability of the sponge 262 and the wiper 261, thereby enhancing a wiping effect of the wiper 261 and the durability of the sponge 262 and the wiper 261.

Figure 11:
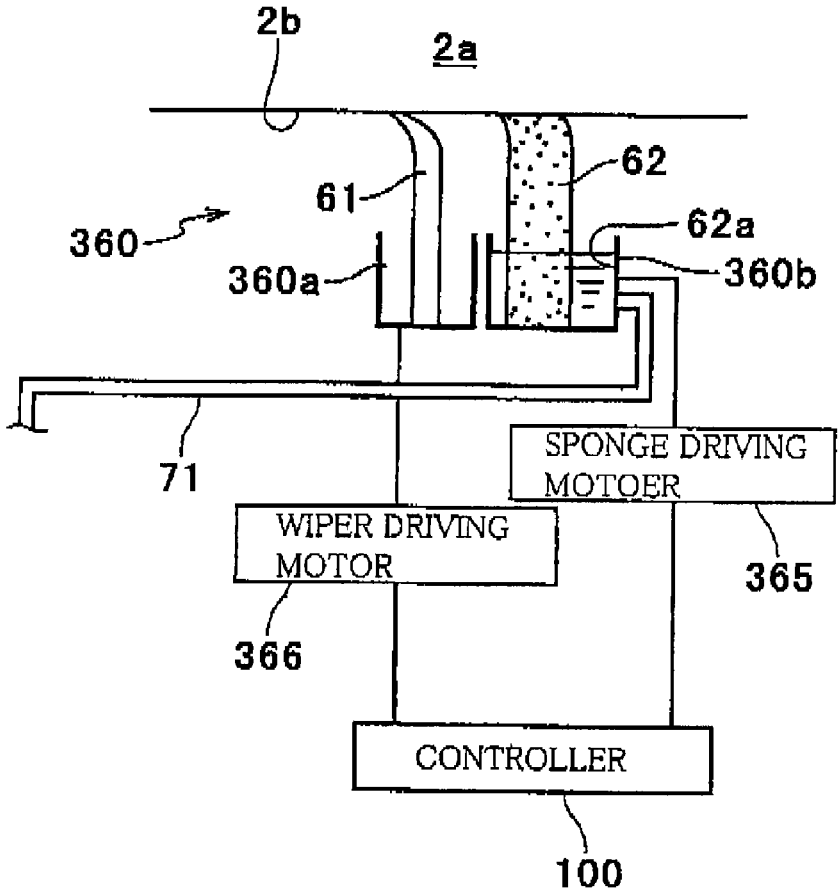
FIG. 11 is a schematic view showing a wiping unit as a third modified example.

Referring next to FIG. 11, there will be explained a third modified example of the wiping unit. In a wiping unit 360 of the third modified example, the wipers 61 and the sponges 62 are individually supported by a wiper frame 360*a* and a sponge frame 360*b*, respectively. As in the above-mentioned embodiment, the sets of the wipers 61 and the sponges 62 are provided for the respective heads 2, and the four wipers 61 respectively corresponding to the heads 2 are supported by the wiper frame 360*a*, while the four sponges 62 respectively corresponding to the heads 2 are supported by the sponge frame 360*b*. A sponge driving motor (first section) 365 drives the sponge frame 360*b* to be moved, while a wiper driving motor (second section) 366 drives the wiper frame 360*a* to be moved.

In the wiping unit 360 of the third modified example, for each head 2, the sponge 62 and the wiper 61 can be individually driven, whereby a wiping operation using the sponge 62 and the wiper 61 and a wiping operation not using the sponge 62 but using only the wiper 61 can be selectively performed. For instance, where a viscosity of the ink adhering to the ink ejection surface 2*b* has increased and therefore the ink having the increased viscosity cannot be wiped by only the wiper 61, the sponge 62 and the wiper 61 are moved together in a state in which the sponge 62 and the wiper 61 are adjacent to each other, whereby a wiping operation which is similar to the operation in the case shown in FIG. 7 of the above-mentioned embodiment can be performed by using the sponge 62 and the wiper 61. On the other hand, where the ink adhering to the ink ejection surface can be wiped by only the wiper 61, only the wiper 61 is moved while the sponge 62 is stopped at their stand-by position, whereby the wiping operation can be performed by using only the wiper 61. In a structure in which the sponge 62 and the wiper 61 cannot be individually driven, when the sponge 62 is driven in the case in which the sponge 62 is not needed in the wiping operation, problems may be caused in a drive force of a motor, a vibration, or the like. These problems can be avoided by the wiping unit 360 of the third modified example.

While the preferred embodiments of the present invention has been described above, it is to be understood that the present invention is not limited to the details of the illustrated embodiments, but may be embodied with various changes, modifications without departing from the spirit and scope of the present invention.

For instance, in the above-mentioned embodiment, the wiper 61 and the sponge 62 for each head 2 are moved relative to the head 2 in a state in which the head 2 is fixed at a predetermined position, but the head 2 may be moved relative to the wiper 61 and the sponge 62 in a state in which the wiper 61 and the sponge 62 are fixed.

One set of the wiper 61 and the sponge 62 is provided for each head 2, but two or more sets may be provided for each head 2, and one set may also be provided commonly for the four heads 2.

A shape of the wiper 61 is not limited to a plate-like shape as long as the wiper 61 can wipe the ink and the foreign substances from the ink ejection surface 2*b*. As a material and a shape of the sponge 62, there may be employed various materials and shapes as long as the sponge 62 can absorb the ink and adhere the absorbed ink to the ink ejection surface 2*b* by contact therewith.

The wiping operation may be performed such that each of the wiping units 60, 160, 260, 360 is moved not along a longitudinal direction of the heads 2 but along a width direction of the heads 2.

Each of the waste-ink receiving mechanisms which receive the ink ejected from the nozzle openings is not limited to include, as described in the above-mentioned embodiment, the area in the waste ink tray 90, the area in the waste ink tank 70, the tube 71, and the pump 73, but there may be employed various structures as the waste-ink receiving mechanism as long as the waste-ink receiving mechanism can receive the ink ejected from the nozzle openings.

In the above-mentioned embodiment, the wiping operation is performed on the basis of a number of recorded sheets, but may be performed on the basis of an elapsed time of recording. Further, the wiping operation is not limited to be performed on the basis of a wiping command from a user. For instance, the wiping operation may be performed only when the purging operation is terminated and when the elapsed time of recording reaches a predetermined time.

Where two or more heads 2 which eject the respective inks mutually different in a sort are provided, the inside of the waste ink tray 90 and the inside of the waste ink tank 70 are not limited to be partitioned to form the areas corresponding to the respective heads 2, and the sponge 62 and the wiper 61 of each set are not limited to be independently provided for the head 2.

The number of the heads 2 is not limited to four, but one, two, three, or five or more ink-jet heads 2 may be provided. Where a single head 2 is provided or where a plurality of heads 2 for one color are provided, the problems such as the aggregation are not caused even if the inside of the waste ink tray 90 and the inside of the waste ink tank 70 are not partitioned or even if the sponge 62 and the wiper 61 of each set are not independently provided for the head 2.

In each of the two or more heads 2 which eject the respective inks mutually different in a sort, the ink adhered to the ink ejection surface 2*b* by the sponge 62 and the ink ejected from the nozzle openings are not limited to be the same in the sort.

The sponge 62 and the wiper 61 of each set are not limited to be located on a virtual straight line which extends in a direction (in the right and left direction in FIG. 6) in which the sponge 62 and the wiper 61 are moved relative to the head 2 when the wiping-unit driving motor 65 is driven, and the sponge 62 and the wiper 61 are not limited to be moved along the virtual straight line. Further, the sponge 62 and the wiper 61 are not limited to be moved together at the same speed along the virtual straight line, but may be moved individually at different speeds from each other.

In the wiping operation using the sponge 62, 162, 262 for each head 2, the distal end of the sponge 62, 162, 262 is not limited to be flexed, as long as the sponge 62, 162, 262 may be held in contact with the ink ejection surface 2*b*.

The ink-jet recording apparatus according to the present invention is not limited to the line-type printer, but may be applied to a serial-type printer. The principle of the present invention is applicable not only to the printer, but also to recording devices such as a facsimile machine and a copying machine.

What is claimed is:

1. An ink jet recording apparatus, comprising:

an ink-jet head including a plurality of nozzle openings from which ink is ejected and an ink ejection surface in which the plurality of nozzle openings are formed;

a waste-ink receiving mechanism comprising:

(a) a tray distantly separated from the ink jet head and configured to receive ejected ink as a waste ink forced to be ejected from the plurality of nozzle openings when the tray is disposed to be opposed to the ink ejection surface; and (b) a container which contains the ejected ink received by the tray;

a tube through which the ejected ink is transferred from the container to an ejected-ink-absorbing member;

a supplier which supplies the ejected ink in the container to the ejected-ink-absorbing member via the tube;

a set of (a) a wiper configured to wipe the ink adhering to the ink ejection surface and (b) the ejected-ink-absorbing member configured to retain the ejected ink supplied by the supplier via the tube in the form of liquid by absorbing the ejected ink received by the waste-ink receiving mechanism and configured to be brought into contact with the ink ejection surface such that the ejected-ink-absorbing member adheres the ejected ink thereto; and a driving mechanism configured to drive at least one of the ink-jet head and the set of the wiper and the ejected-ink-absorbing member, such that the wiper and the ejected-ink-absorbing member are, one of together and independently, moved relative to the ink ejection surface while being opposed thereto, and such that the ejected-ink-absorbing member adheres the ejected ink to the ink ejection surface and the wiper wipes the ejected ink adhered by the ejected-ink-absorbing member from the ink ejection surface, wherein the ejected-ink-absorbing member is configured to retain the ejected ink in the form of the liquid therein before the ejected-ink-absorbing member is brought into contact with the ink ejection surface.

2. The ink jet recording apparatus according to claim 1, wherein the tray has a bottom surface inclined such that a distance between the bottom surface and the ink ejection surface gradually increases toward a certain portion thereof, and wherein the waste-ink receiving mechanism is configured to send the ink ejected from the plurality of nozzle openings from the certain portion to the container.

3. The ink jet recording apparatus according to claim 1, further comprising a controller which controls the driving mechanism.

4. The ink jet recording apparatus according to claim 3, wherein the controller is configured to control the driving mechanism on the basis of at least one of a number of recorded media recorded by using the ink jet head and an elapsed time of recording by using the ink-jet head.

5. The ink jet recording apparatus according to claim 3, wherein the controller includes a command-receiving portion which receives a command from a user and is configured to control the driving mechanism on the basis of the command received by the command-receiving portion.

6. The ink jet recording apparatus according to claim 1, comprising a plurality of ink-jet heads each as the ink-jet head which eject, from the plurality of nozzle openings, respective inks mutually different in a sort.

7. The ink jet recording apparatus according to claim 6, comprising a plurality of waste-ink receiving mechanisms each as the waste-ink receiving mechanism which respectively correspond to the plurality of ink jet heads.

8. The ink jet recording apparatus according to claim 6, comprising a plurality of sets each as the set of the wiper and the ejected-ink-absorbing member which respectively correspond to the plurality of ink-jet heads.

9. The ink jet recording apparatus according to claim 6, configured such that, in each of the plurality of ink-jet heads, the ink ejected from the plurality of nozzle openings and the ink adhered to the ink ejection surface by the ejected-ink-absorbing member are the same in the sort.

10. The ink jet recording apparatus according to claim 1, wherein the driving mechanism is configured to drive the at least one of the ink jet head and the set of the wiper and the ejected-ink-absorbing member in a state in which a distal end of the ejected-ink-absorbing member is further from the ink ejection surface than a distal end of the wiper in a direction perpendicular to the ink ejection surface.

11. The ink jet recording apparatus according to claim 1, wherein the driving mechanism is configured to selectively establish a state in which both of a distal end of the wiper and a distal end of the ejected-ink-absorbing member contact the ink ejection surface, and a state in which the distal end of the wiper contacts the ink ejection surface while the distal end of the ejected-ink-absorbing member does not contact the ink ejection surface.

12. The ink jet recording apparatus according to claim 1, wherein the driving mechanism is configured to drive the at least one of the ink jet head and the set of the wiper and the ejected-ink-absorbing member in a state in which a distal end of the ejected-ink-absorbing member is nearer to the ink ejection surface than a distal end of the wiper in a direction perpendicular to the ink ejection surface.

13. The ink jet recording apparatus according to claim 1, wherein the driving mechanism is configured to change positions of respective distal ends of the wiper and the ejected-ink-absorbing member in a direction perpendicular to the ink ejection surface independently of each other.

14. The ink jet recording apparatus according to claim 1, wherein the driving mechanism includes (A) a first section which drives at least one of the ink jet head and the ejected-ink-absorbing member, such that the ejected-ink-absorbing member is moved relative to the ink ejection surface while being opposed thereto and (B) a second section which drives at least one of the ink jet head and the wiper, such that the wiper is moved relative to the ink ejection surface while being opposed thereto.

15. The ink jet recording apparatus according to claim 1, wherein the ejected-ink-absorbing member and the wiper are located on a virtual straight line which extends in a direction in which one of the ejected-ink-absorbing member and the wiper is moved relative to the ink ejection surface, and wherein the driving mechanism is configured to drive the at least one of the ink jet head and the set of the wiper and the ejected-ink-absorbing member such that the wiper and the ejected-ink-absorbing member are moved relative to the ink ejection surface along the virtual straight line.

16. The ink jet recording apparatus according to claim 15, wherein the driving mechanism is configured to drive the at least one of the ink-jet head and the set of the wiper and the ejected-ink-absorbing member such that the wiper and the ejected-ink-absorbing member are, together at the same speed, moved relative to the ink ejection surface along the virtual straight line.

17. The ink jet recording apparatus according to claim 1, wherein the ejected-ink-absorbing member comprises a sponge configured to absorb the ejected ink and a frame which has a bottom face continued to four side walls having side by side connection and in which the sponge is disposed, wherein the tube connects the container and the frame, and wherein the supplier is configured to supply the ejected ink to an inside of the frame such that the sponge retains the supplied ejected ink.

18. The ink jet recording apparatus according to claim 1, further comprising a controller configured to control the supplier such that the supplier supplies the ejected ink in the container to the ejected-ink-absorbing member.

19. The ink jet recording apparatus according to claim 18, wherein the supplier is a pump which is provided for the tube, and wherein the ejected ink is supplied to the ejected-ink-absorbing member through the tube when the pump is driven by the control of the controller.

20. The ink-jet recording apparatus according to claim 18, wherein the controller is configured to control the driving mechanism, and wherein the controller includes a command-receiving portion configured to receive a command and is configured to control the driving mechanism and the supplier on the basis of the command received by the command-receiving portion.

21. An ink jet recording apparatus comprising:

an ink-jet head including a plurality of nozzle openings from which ink is ejected and an ink ejection surface in which the plurality of nozzle openings are formed;

a waste-ink receiving mechanism comprising:

(a) a tray distantly separated from the ink jet head and configured to receive the ink as a waste ink in a purging operation in which the ink is forced to be ejected from the plurality of nozzle openings when the tray is disposed to be opposed to the ink ejection surface;

(b) a container which contains the waste ink received by the tray;

(c) a tube which connects the container to an absorbing member; and (d) a supplier which supplies the waste ink in the container to the absorbing member via the tube;

a set of (a) a wiper configured to wipe the ink adhering to the ink ejection surface and (b) the absorbing member configured to retain the waste ink in the form of liquid by absorbing the waste ink received by the waste-ink receiving mechanism and configured to be brought into contact with the ink ejection surface such that the absorbing member adheres the waste ink thereto; and a driving mechanism configured to drive at least one of the ink-jet head and the set of the wiper and the absorbing member, such that the wiper and the absorbing member are, one of together and independently, moved relative to the ink ejection surface while being opposed thereto, and such that the absorbing member adheres the waste ink to the ink ejection surface and the wiper wipes the waste ink adhered by the absorbing member from the ink ejection surface, wherein the absorbing member is configured to retain the waste ink in the form of the liquid therein before the absorbing member is brought into contact with the ink ejection surface, wherein the absorbing member comprises a sponge configured to absorb the waste ink and a frame which has a bottom face continued to four side walls having side by side connection and in which the sponge is disposed, wherein the tube connects the container and the frame, wherein the supplier is configured to supply the waste ink to an inside of the frame such that the sponge retains the supplied waste ink, wherein the tube is connected to one of the side walls of the frame, and wherein the sponge is distant from the side wall to which the tube is connected.

22. The ink jet recording apparatus according to claim 17, wherein a distal end of the sponge is higher than upper faces of the respective side walls of the frame in a direction perpendicular to the ink ejection surface.

23. The ink jet recording apparatus according to claim 1, wherein the purging operation is an operation in which the ink passes through the plurality of nozzle openings in a direction from the ink jet head toward the tray.

24. The ink jet recording apparatus according to claim 1, wherein the purging operation is an operation which is performed on an inside of the ink jet recording apparatus.

25. The ink jet recording apparatus according to claim 17, further comprising a controller configured to control the supplier, such that the supplier supplies the ejected ink in the container to the ejected-ink-absorbing member, wherein the controller controls the supplier, such that the ejected ink inside the frame is kept at a constant amount.

* * * * *